US010854415B1

(12) United States Patent
Chiu

(10) Patent No.: US 10,854,415 B1
(45) Date of Patent: Dec. 1, 2020

(54) FUSE

(71) Applicant: CONQUER ELECTRONICS CO., LTD., Taipei (TW)

(72) Inventor: Hung-Chih Chiu, Taipei (TW)

(73) Assignee: CONQUER ELECTRONICS CO., LTD., Taipei (TW)

( * ) Notice: Subject to any disclaimer, the term of this patent is extended or adjusted under 35 U.S.C. 154(b) by 0 days.

(21) Appl. No.: 16/937,555

(22) Filed: Jul. 23, 2020

Related U.S. Application Data

(62) Division of application No. 16/542,231, filed on Aug. 15, 2019.

(51) Int. Cl.
*H01H 85/38* (2006.01)
*H01H 85/055* (2006.01)
*H01H 85/165* (2006.01)
*H01H 85/143* (2006.01)

(52) U.S. Cl.
CPC ..... *H01H 85/38* (2013.01); *H01H 85/055* (2013.01); *H01H 85/143* (2013.01); *H01H 85/165* (2013.01)

(58) Field of Classification Search
CPC .... H01H 85/38; H01H 85/055; H01H 85/143; H01H 85/0458; H01H 85/157; H01H 85/165; H01H 85/0418
USPC ..... 337/187, 228, 248
See application file for complete search history.

(56) References Cited

U.S. PATENT DOCUMENTS 1,121,876 A * 12/1914 Schipper ..... H01H 85/157 337/234
1,353,123 A * 9/1920 Kries ..... H01H 85/0456 337/229
3,418,614 A * 12/1968 Krueger ..... H01H 85/0458 337/164
4,032,879 A * 6/1977 Monagan ..... H01H 85/42 337/278
4,308,515 A * 12/1981 Rooney ..... H01H 85/055 337/162
4,322,704 A * 3/1982 Kozacka ..... H01H 85/055 337/159
4,417,224 A * 11/1983 Ross ..... H01H 85/055 337/164
4,560,971 A * 12/1985 Oh ..... H01H 85/055 337/164
4,870,386 A * 9/1989 Arikawa ..... H01H 85/055 337/162

(Continued)

*Primary Examiner* — Stephen S Sul
(74) *Attorney, Agent, or Firm* — Leong C. Lei

(57) ABSTRACT

A fuse includes a tubular body having two ends each having a first cap, which is formed with a through hole; a fusible and breakable unit including a first fusible filament arranged inside the tubular body and having two ends extending outward through the through holes respectively; and a plurality of second caps each of which has a surface that is formed with a recessed part and an opposite surface that is provided with a conductive wire. The recessed parts of the second caps are mounted to outer circumferences of the first caps. The two ends of the first fusible filament are respectively coupled between the first caps and the second caps corresponding thereto so as to extend a distance between the two ends of the first fusible filament and thus, preventing the occurrences of electrical arc after the first fusible filament is fused and broken.

3 Claims, 5 Drawing Sheets

(56) References Cited

U.S. PATENT DOCUMENTS

| | | | | | |
|---|---|---|---|---|---|
| 4,973,932 | A * | 11/1990 | Krueger | ..... | H01H 85/055<br>337/162 |
| 2018/0053617 | A1 * | 2/2018 | Miller | ..... | H01H 85/175 |

* cited by examiner

FUSE

CROSS-REFERENCE TO RELATED APPLICATIONS

This is a divisional application of co-pending patent application Ser. No. 16/542,231, filed on Aug. 15, 2019.

TECHNICAL FIELD OF THE INVENTION

The present invention provides a circuit protection device, and more particularly to an active heating fuse.

DESCRIPTION OF THE PRIOR ART

Fuses have been widely used in electronic devices and electrical devices to provide protection against damage caused by an excessively large electrical current. The protection that a fuse provides is that when an electrical current passes through an electrically conductive fusible filament having a predetermined resistance, in case that the electrical current exceeds a rated current, the fusible filament gets over-heated and thus fused and broken to block the electrical current from further flowing into a device. The higher the resistance is after breaking, the better the effect of blocking will be. Generally, the larger a cross-sectional area of a fuse is, the lower the resistance thereof will be and the higher the rated current will be. In a series connection arrangement between a fuse and a circuit to be protected, it is better if a voltage drop and a temperature rise are less within the operation range of rated current. A fuse, after getting heated by an excessively large current, will generate an electric arc before it is fully fused and completely broken, and this is generally an instantaneous localized high energy that demonstrates a strong power of damage. This is an important factor that must be taken into account in designing and manufacturing a fuse.

Further, known fuses have an additional shortcoming. Soldering points at two ends of a fuse are very close to each other, and thus, after the fuse has molten and broken, an electrical arc may still generate between the soldering points at the two ends of the fuse, making the protection mechanism fail.

SUMMARY OF THE INVENTION

In view of the above-discussed drawbacks, the present invention provides a fuse that comprises a tubular body, which has two ends each of which is provided with a first cap, each of the first caps being formed with a through hole; a fusible and breakable unit, which comprises a first fusible filament arranged in an interior of the tubular body, the first fusible filament having two ends that extend outward through the through holes respectively; and a plurality of second caps, each of the second caps having a surface that is formed with a recessed part and an opposite surface that is provided with a conductive wire, the recessed part of each of the second caps being mounted to an outer circumference of a corresponding one of the first caps, the two ends of the first fusible filament being respectively coupled between the first caps and the second caps corresponding thereto so as to extend a distance between the two ends of the first fusible filament and thus, preventing the occurrences of electrical arc after the first fusible filament is fused and broken.

DETAILED DESCRIPTION OF THE PREFERRED EMBODIMENT

Figure 1:
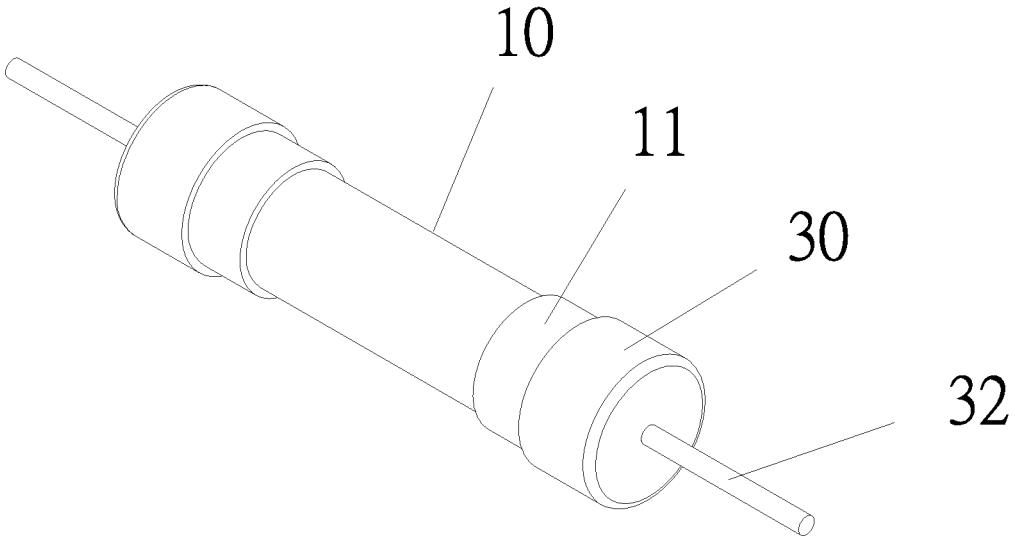
FIG. 1 is a perspective view showing a first embodiment of the present invention.

To better explain the technical contents of the present invention and advantages achievable thereby, embodiments will be described with reference to the attached drawings. Reference is first made to FIG. 1, which is a perspective view showing a first embodiment of the present invention. A fuse according to the present invention comprises: a tubular body 10, a fusible and breakable unit 20, and a plurality of second caps 30. All these elements will be individually described below.

The tubular body 10 has two ends each of which is provided with a first cap 11. Each of the first caps 11 is formed with a through hole 111. The tubular body 10 has a shape of a hollow cylinder or a hollow rectangular cuboid.

Figure 2:
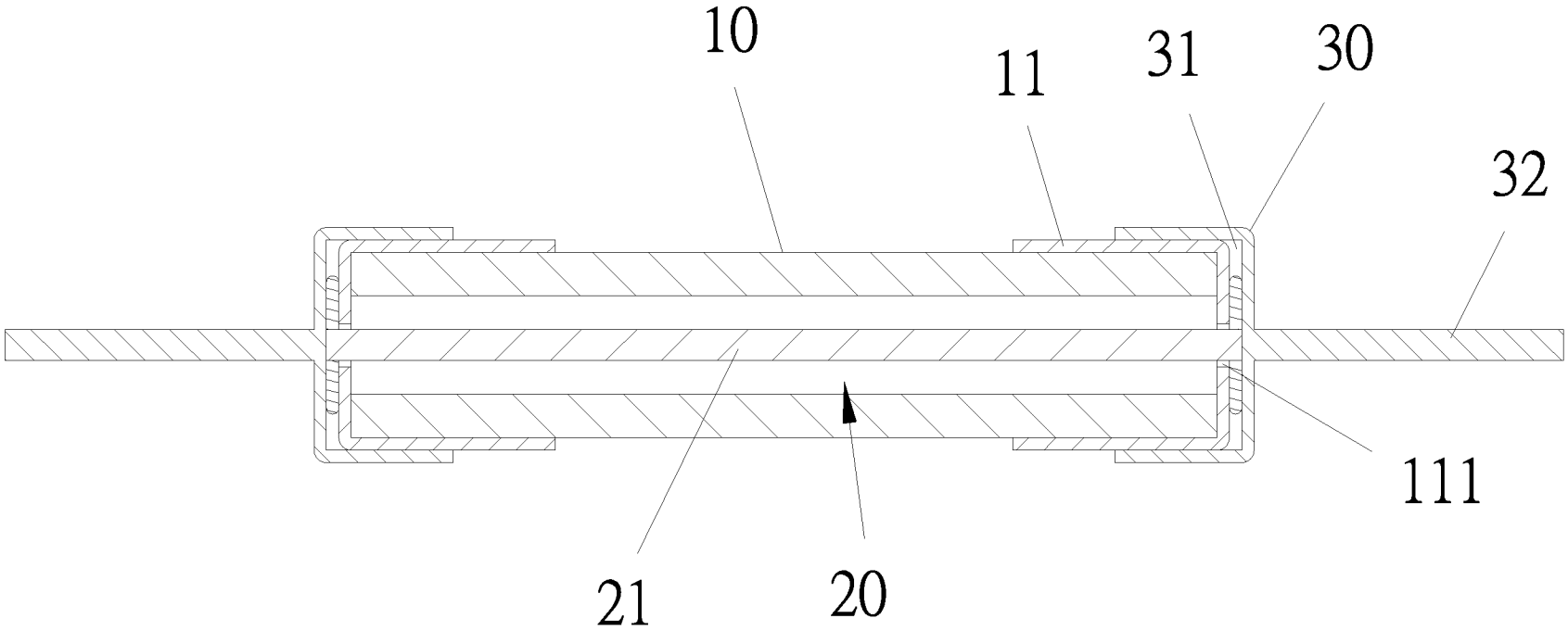
FIG. 2 is a cross-sectional view of FIG. 1.

Referring to FIGS. 1 and 2, the fusible and breakable unit 20 comprises a first fusible filament 21 arranged in an interior of the tubular body 10. The first fusible filament 21 has two ends extending outward through the through holes 111, respectively.

The second caps 30 are provided such that each of the second caps 30 has one surface that is formed with a recessed part 31 and an opposite surface that is provided with a conductive wire 32. Further, as an alternative example, a second cap 30 having no conductive wire 32 may be used to suit a specific need.

The second caps 30 are corresponding to and coupled to the first caps 11 respectively by having the recessed parts 31 fit to outer circumferences of the first caps 11 such that the two ends of the first fusible filament 21 are respectively coupled between the first caps 11 and the corresponding second caps 30 in order to extend a distance between the two ends of the first fusible filament.

In such an arrangement, the first caps 11, the fusible and breakable unit 20, and the second caps 30 are respectively coupled together through soldering, such that the soldering sites are located external of the tubular body 10 and each between a respective one of the first caps 11 and the corresponding second cap 30. This is referred to as "external soldering", which helps increase the distance between the two ends of the first fusible filament 21. This helps prevents the occurrences of electrical arcs that makes it not possible to achieve open-circuiting when the first fusible filament 21 is being fused and broken.

Figure 3:
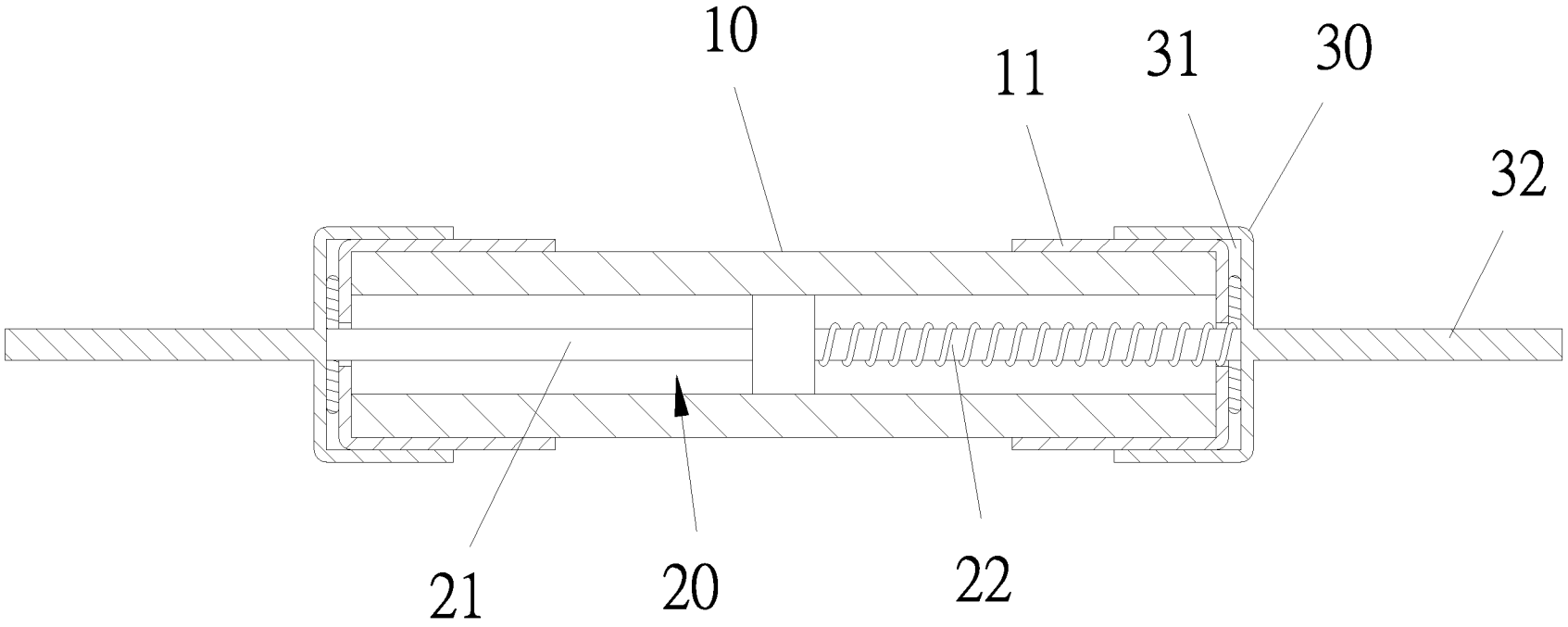
FIG. 3 is a cross-sectional view showing a second embodiment of the present invention.

Referring to FIG. 3, a second embodiment of the present invention is shown, in which some parts are similar or identical to counterparts thereof in the first embodiment, so that repeated description will be omitted herein.

In the instant embodiment, the fusible and breakable unit 20 comprises a first fusible filament 21 and a second fusible filament 22 that is connected to, or otherwise combined with, the first fusible filament 21. The first fusible filament 21 has a melting point that is lower than a melting point of the second fusible filament 22. The first fusible filament 21 and the second fusible filament 22 are arranged in an interior of the tubular body 10 and the first fusible filament 21 and the second fusible filament 22 each have an end extending outward through one the through holes 111 corresponding thereto.

Figure 4:
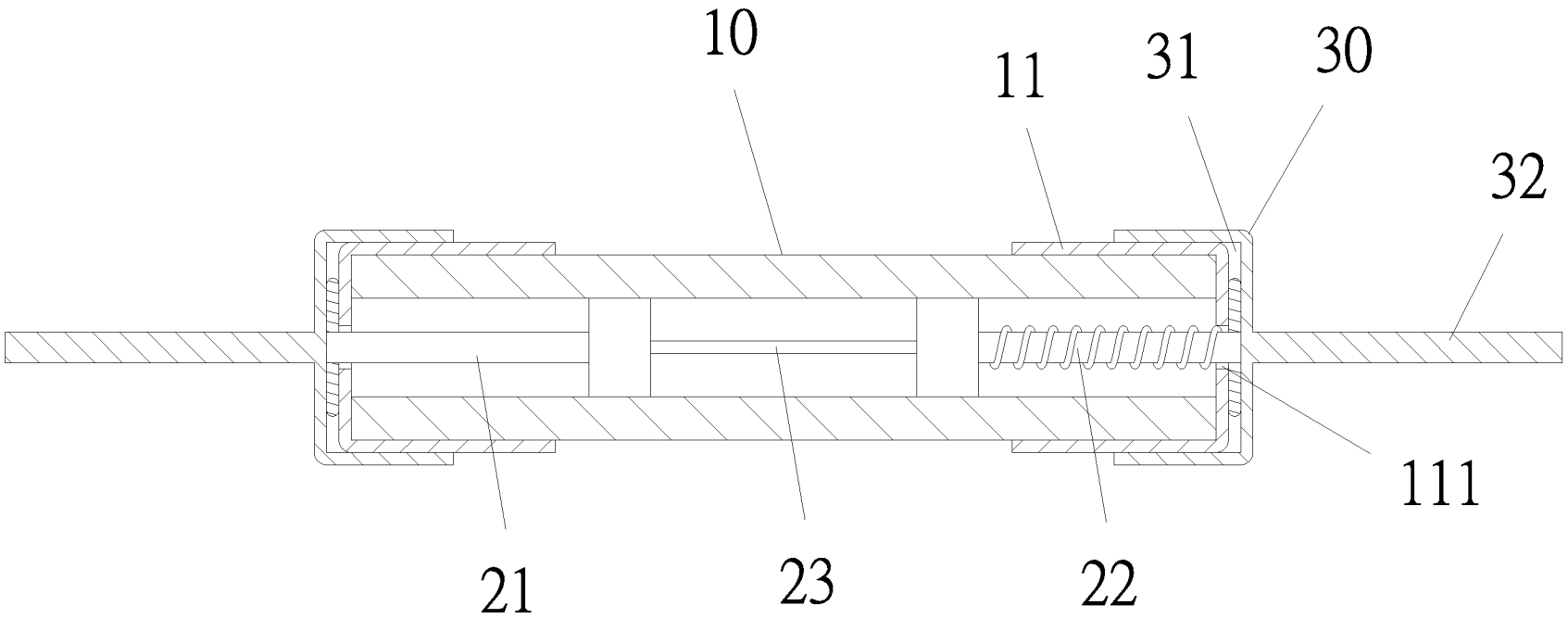
FIG. 4 is a cross-sectional view showing a third embodiment of the present invention.

One advantage of the present invention is that a first fusible filament 21 and a second fusible filament 22 having different melting points can be used in combination to suit a specific need for the purposes of protection. Further, referring to FIG. 4, as an alternative, in a third embodiment of the present invention, a third fusible filament 23 may be arranged and connected between the first fusible filament 21 and the second fusible filament 22. The melting point of the second fusible filament 22 is lower than a melting point of the third fusible filament 23. Further, as illustrative examples, the first fusible filament 21, the second fusible filament 22, and the third fusible filament 23 can each be a fusible filament having a line form, a spring form, or a plate form.

Figure 5:
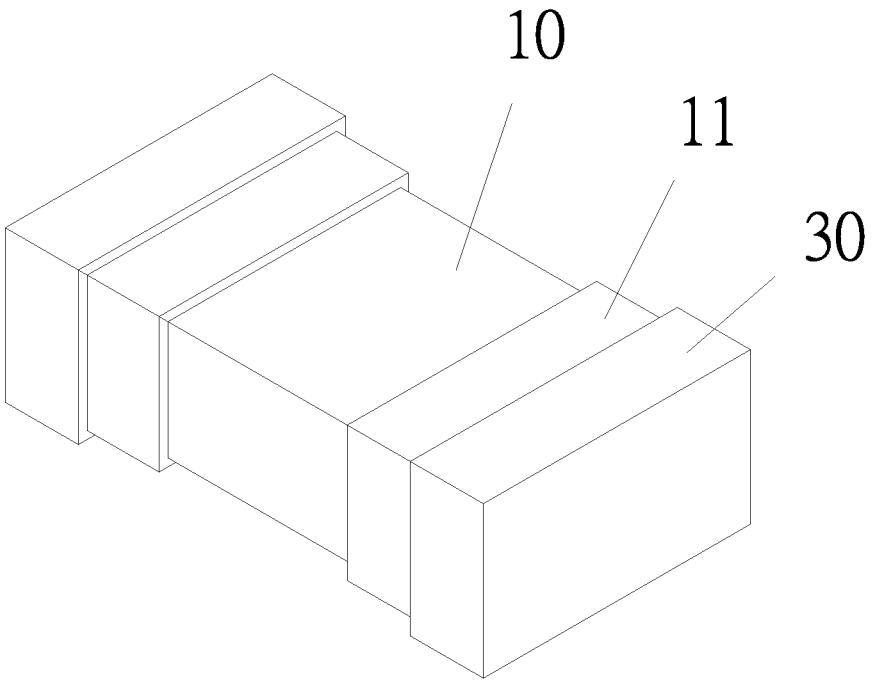
FIG. 5 is a perspective view showing a fourth embodiment of the present invention.

Referring to FIG. 5, which is a perspective view showing a fourth embodiment of the present invention, the fourth embodiment has an external shape of the embodiment that is changed from a cylinder provided in FIG. 1 to a rectangular cuboid, and in this embodiment, none of the second caps 30 is provided with a conductive wire 32 to easy use in circuits of different specifications.

I claim:

1. A fuse, comprising:

a tubular body, which has two ends each of which is provided with a first cap, each of the first caps being formed with a through hole;

a fusible and breakable unit, which comprises a first fusible filament and a second fusible filament connected to the first fusible filament, the first fusible filament having a melting point that is lower than a melting point of the second fusible filament, the first fusible filament and the second fusible filament being arranged in an interior of the tubular body, the first fusible filament and the second fusible filament each having an end extending outward through one of the through holes, a third fusible filament arranged to connect between the first fusible filament and the second fusible filament, the melting point of the second fusible filament being lower than a melting point of the third fusible filament; and a plurality of second caps, each of the second caps having a surface that is formed with a recessed part and an opposite surface that is provided with a conductive wire, the recessed part of each of the second caps being mounted to an outer circumference of a corresponding one of the first caps, the ends of the first fusible filament and the second fusible filament being respectively coupled between the first caps and the second caps corresponding thereto.

2. The fuse according to claim 1, wherein the tubular body has a shape of a hollow cylinder or a hollow rectangular cuboid.

3. The fuse according to claim 1, wherein the first caps, the fusible and breakable unit, and the second caps are coupled through soldering.

* * * * *